US011377316B2

(12) United States Patent
Gutierrez Garcia et al.

(10) Patent No.: US 11,377,316 B2
(45) Date of Patent: Jul. 5, 2022

(54) MEDIA CONVEYORS WITH SUCTION HOLES

(71) Applicant: HEWLETT-PACKARD DEVELOPMENT COMPANY, L.P., Spring, TX (US)

(72) Inventors: Daniel Gutierrez Garcia, Sant Cugat del Valles (ES); Roger Terradellas Callau, Sant Cugat del Valles (ES); Raimon Castells De Monet, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 734 days.

(21) Appl. No.: 16/340,629

(22) PCT Filed: Oct. 17, 2016

(86) PCT No.: PCT/US2016/057290

§ 371 (c)(1),
(2) Date: Apr. 9, 2019

(87) PCT Pub. No.: WO2018/074987

PCT Pub. Date: Apr. 26, 2018

(65) Prior Publication Data

US 2020/0047525 A1 Feb. 13, 2020

(51) Int. Cl.

| | |
|---|---|
| ***B65H 11/00*** | (2006.01) |
| ***B41J 11/00*** | (2006.01) |
| ***B65H 5/22*** | (2006.01) |

(52) U.S. Cl.

CPC ..... *B65H 11/005* (2013.01); *B41J 11/0085* (2013.01); *B65H 5/222* (2013.01); *B65H 5/224* (2013.01); *B65H 2406/3124* (2013.01); *B65H 2406/3222* (2013.01); *B65H 2406/418* (2013.01)

(58) Field of Classification Search

CPC ..... B65H 5/02; B65H 5/224; B65H 11/005; B65H 2406/3124; B65H 2406/3222; B65H 2406/418; F16K 7/02; F16K 7/12; F16K 99/0015

See application file for complete search history.

(56) References Cited

U.S. PATENT DOCUMENTS

| | | | | |
|---|---|---|---|---|
| 5,839,722 | A | 11/1998 | Berlin et al. | |
| 6,722,652 | B2 | 4/2004 | Kobayashi et al. | |
| 7,584,957 | B2 * | 9/2009 | Edinger | B65H 5/22 271/197 |
| 7,651,091 | B2 | 1/2010 | McNally et al. | |

(Continued)

FOREIGN PATENT DOCUMENTS

| | | | |
|---|---|---|---|
| CN | 101925959 | A | 12/2010 |
| JP | 2009280320 | A | 12/2009 |

OTHER PUBLICATIONS

HPDC, "International Search Report and Written Opinion," Jul. 6, 2017, International App. No. PCT/US2016/057290, 7 p.

*Primary Examiner* — Prasad V Gokhale
(74) *Attorney, Agent, or Firm* — HP Inc. Patent Department

(57) ABSTRACT

In an example, a media conveyor includes a media support platform having a suction hole, and a valve to selectively close the suction hole. A valve actuator to actuate the valve includes an air tube having an air inlet and a seal to selectively seal the air inlet.

15 Claims, 4 Drawing Sheets

(56) References Cited

U.S. PATENT DOCUMENTS

| | | | | |
|---|---|---|---|---|
| 8,070,156 | B2 | 12/2011 | Yoda et al. | |
| 9,073,365 | B2 | 7/2015 | Satake | |
| 9,108,444 | B2 | 8/2015 | Satake | |
| 9,290,018 | B1 | 3/2016 | Vandagriff et al. | |
| 10,435,259 | B2 * | 10/2019 | Arredondo Rosales | B65H 11/00 |
| 2004/0164482 | A1 * | 8/2004 | Edinger | B65H 11/005 271/197 |
| 2007/0090593 | A1 * | 4/2007 | McNally | B41J 13/226 271/276 |
| 2009/0244242 | A1 | 10/2009 | Sawada | |
| 2010/0109235 | A1 | 5/2010 | Sugiyama et al. | |
| 2010/0118098 | A1 | 5/2010 | Ebihara | |
| 2012/0069076 | A1 | 3/2012 | Higuchi | |
| 2018/0305157 | A1 * | 10/2018 | Veis | B65H 5/224 |

* cited by examiner

MEDIA CONVEYORS WITH SUCTION HOLES

BACKGROUND

In some media handling apparatus, such a printers, media stackers or the like, media conveyors, such as belt-type conveyors, rollers or pallets on an endless track are used to convey media, for example media on to which text or an image may be printed. For example, such media conveyors may be used to convey media from a media storage area to a position in which it can be printed (for example, near a printhead of the printer or the like) and then to convey the media to a curing and/or collection area.

BRIEF DESCRIPTION OF DRAWINGS

Non-limiting examples will now be described with reference to the accompanying drawings, in which.

DETAILED DESCRIPTION

Figure 1:
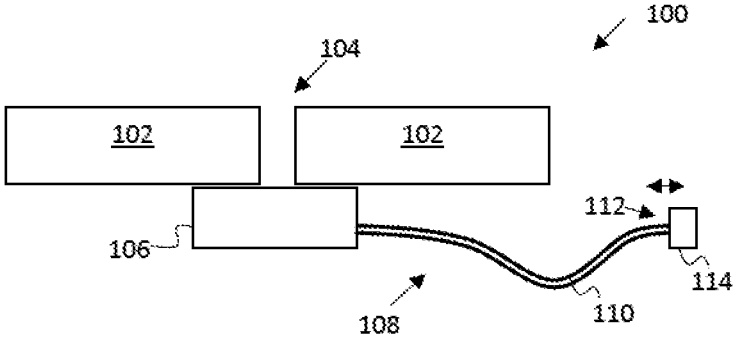
FIG. 1 is a schematic diagram of an example media conveyor.

FIG. 1 shows a schematic diagram of an example of a media conveyor 100 comprising a media support platform 102. A suction hole 104 is provided through the media support platform 102 (which may be a moving platform, or may be covered with a belt or the like), and a valve 106 is arranged to selectively close the suction hole 104. Associated with the valve 106 is a valve actuator 108 comprising an air tube 110 having an air inlet 112 (in this example, the end of the tube 110, although this could be positioned elsewhere on the tube 110) and a seal 114, which is to selectively seal the air inlet 112. In some examples, the valve 106 may be a pressure operated valve, for example being actuated to selectively close or open the suction hole 104 by a pressure differential in or around the valve 106, wherein the pressure differential may be controlled by sealing or un-sealing the inlet 112 of the air tube 110.

Media conveyors may for example be used in a print apparatus or some other apparatus. In such apparatus, a media conveyor may be used in order to move media, for example a sheet material, such as paper, card stock, plastics, and the like, which may be rigid, substantially rigid or flexible.

Suction may be used to secure the media to a conveyor, for example by drawing air through suction hole(s) in the platform. In previous examples of media conveyors, such suction hole(s) are always open. However, this can result in wasted energy and/or the specification of large vacuum sources, which can be expensive. For example when a media sheet which is narrower than the support platform 102 on which it is transported, in order to maintain suction on the media while air is drawn through uncovered holes, additional power is consumed. In some examples, or in some media handling phases, the air is heated (for example to aid drying or curing of a printed media), and drawing air though open holes effectively wastes the energy consumed in heating the air, and/or may make it difficult to reach a target temperature for the process being carried out.

In some previous examples of media conveyors, holes may be selectively closed using, for example, electrically actuated valves. However, such valves can be expensive and may operate in a relatively hostile environment, which may be hot (for example, up to 90° C.), and apparatus, such as print apparatus, can contain condensation of water and solvents which can be damaging to valve apparatus. Some working practices include manually taping over holes when printing a particular media so as to selectively close suction holes, but this is burdensome on a user. In still further examples, holes may be generally sealed but opened by the presence of a media. For example, a media sheet may cover a pilot hole, which may be smaller than a suction hole, and this may create a pressure differential which opens a valve (for example, moves a moveable diaphragm) covering a suction hole. However, this relies on the media sheet successfully sealing a suction hole. In some examples, this cannot be assured. For example, as is described in greater detail below, a fabric or otherwise porous belt may be provided on the platform 102 and this could impede a seal from forming.

In some examples, the media conveyor 100 may comprise a negative pressure source, for example as described below.

Figure 2A:
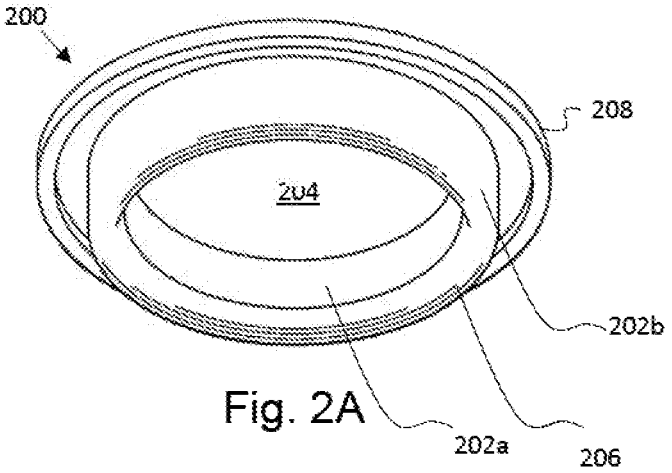
FIGS. 2A and 2B show an example diaphragm of a valve.
Figure 2B:
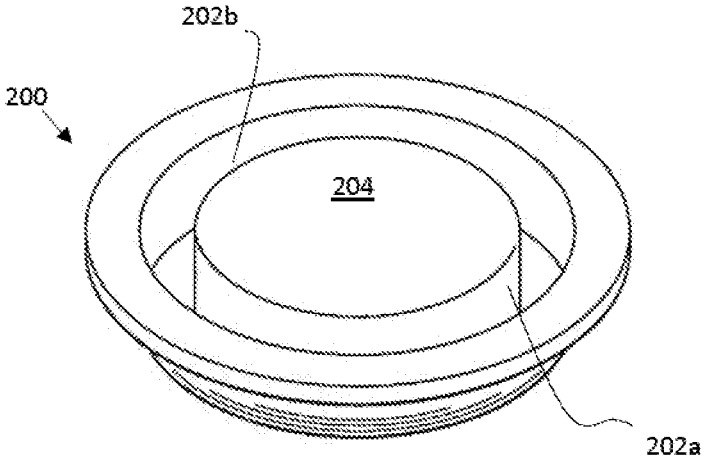

An example of a diaphragm 200, which could provide a component of a valve 106, is shown in different views in FIGS. 2A and 2B. In this example, the diaphragm 200 comprises a resilient (for example, rubber, plastic or the like) diaphragm having a convolution comprising a pair of concentric annular walls 202*a*, 202*b*, which in this example are substantially parallel and are joined at a base region thereof by a flexible portion 206. The diaphragm 200 also comprises a sealing surface 204 and a seat 208, which may interface with other apparatus portions as shown in FIGS. 3A and 3B below.

Figure 3A:
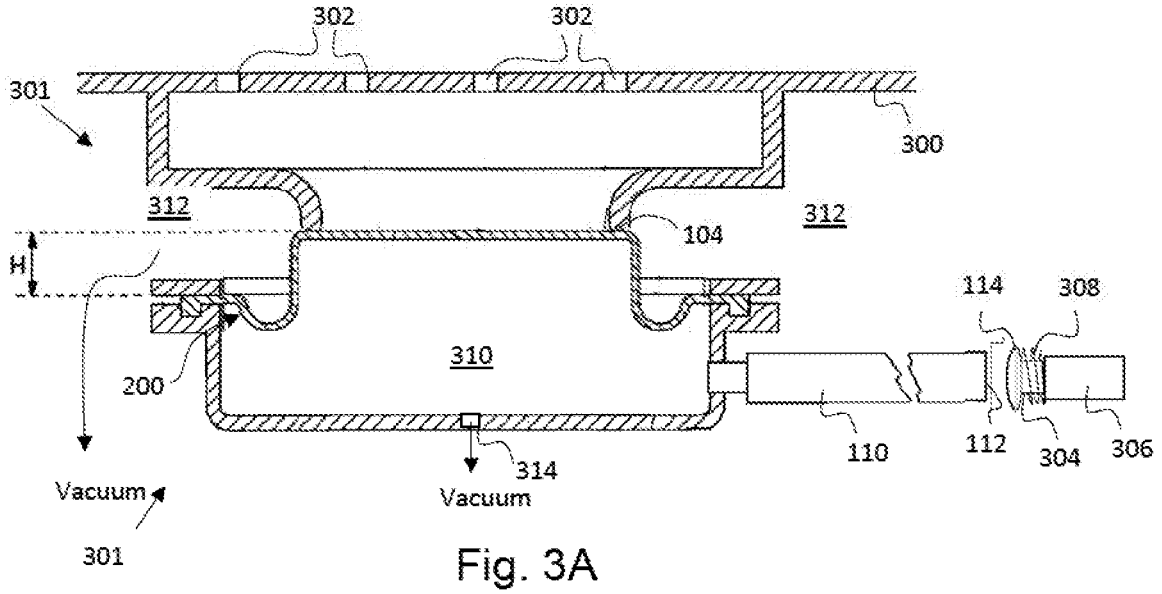
FIGS. 3A and 3B show an example valve in situ in a print media transport apparatus.
Figure 3B:
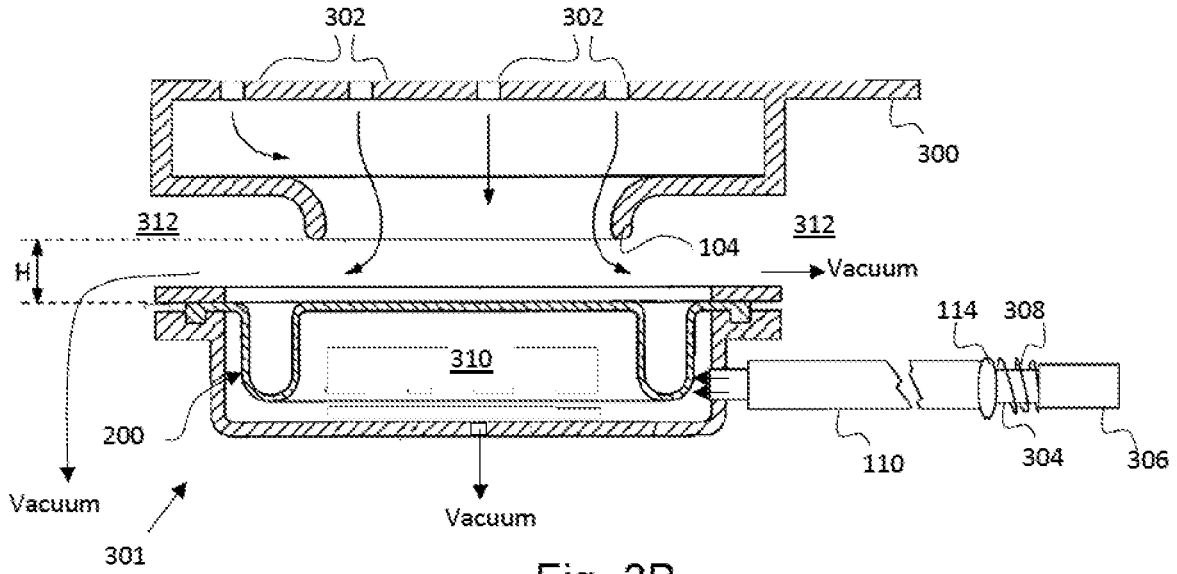

FIGS. 3A and 3B show examples in which a valve 301 comprising a diaphragm 200 is in situ under a media support platform 300.

In this example, the media support platform 300 comprises a plurality of perforations 302 in communication with a suction hole 104, although in other examples a suction hole 104 may be formed through to the surface of the platform 300. The seal 114 is mounted on a piston 304 which is connected to a drive mechanism, in this example a solenoid 306, such that the position thereof relative to the end of the air tube 110 (which is shown in a broken fashion to indicate that the tube 110 may be longer than illustrated) may be adjusted to block and unblock the inlet 112 at the end of the air tube 110. The solenoid 306 may act against a resilient member, in the example of the Figures, a spring 308. In this example, the positions of the seal 114 are bi-stable: the spring 308 will urge the seal 114 to seal the end of the air tube 110 or the solenoid 306 will draw the piston into a retracted, latched, position.

A solenoid is an example of a robust, low cost drive mechanism which is readily controlled with a simple control system such as an electric pulse. In other examples, other drive mechanisms could be used, for example stepper motors, servos, manual actuation, or the like.

By providing a drive mechanism which is bi-stable, energy is consumed just at the point of state change and therefore power consumption and risk of component burn-out is reduced.

The air tube 110 is connected to a chamber 310 on a first side of diaphragm 200 within the valve 301 and the valve 301 further comprises a region 312 on the second side of the diaphragm 200 within the valve 301. The chamber 310 and the region 312 are in fluid communication with a vacuum source. The chamber 310 is in fluid communication with a vacuum source via a bleed hole 314, which is smaller than the aperture of the air tube 110 (for example, half or a quarter of the surface area). The region 312 on the second side of the diaphragm 200 is arranged so as to have a relatively unrestricted air flow with the vacuum source (when compared to the restriction presented by the bleed hole 314).

In both FIGS. 3A and 3B, a vacuum is applied, as shown in FIG. 3B. In some examples, vacuum pressures may range between a few hundred to a few thousand Pascals, resulting in a suction force of around 500 Pa to 1000 Pa.

In FIG. 3A, the solenoid 306 acts to retract the seal 114 and unseal the end of the air tube 110. The chamber 310 on the first side of the diaphragm is at or slightly below atmospheric pressure: air enters the chamber 310 via the air tube faster than it is removed by the vacuum source via the bleed hole 314 due to their relative sizes. However, the applied vacuum reduces the pressure within the region 312 on the second side of the diaphragm and the resulting pressure difference deforms the diaphragm 200 from its equilibrium shape shown in FIG. 2, and causing it to seal the mouth of the suction hole 104. As the suction hole 104 is closed there is no airflow though the perforations 302 and any media on top of the perforations 302 would not be subject to a suction force.

In FIG. 3B, the latch holding back the seal 114 has been released allowing the spring 308 to act on the seal 114 to urge it toward the end of the air tube 110. The vacuum acts to draw air through the bleed hole 314 and, as this is no longer replaced via the air tube 110, the pressure in the chamber 310 under the sealing surface 204 reduces, causing the sealing surface 204 to be drawn downwards until the diaphragm 200 assumes its rest position and, the sealing surface is a distance H from the mouth of the suction hole 104. As a result, the vacuum acts such that air is drawn through the perforations 302 and the suction hole 104. A sheet of media on the platform 300 will therefore be held by a suction force.

As mentioned above, the cross sectional surface area of the bleed hole 314 is less than that of the air tube 110. In some examples, the diameter of the bleed hole 314 may be in the order of a few millimeters, for example, 1 to 3 mm, whereas the diameter of the air tube 110 may be around 16-20 mm. More generally, the ratio between these sizes (or the size of the inlet 112, if different from the size of the tube 110) will determine the response time of the diaphragm 200. In some examples, the diameter of the bleed 314 hole is significantly less than the diameter of the air tube 110.

The drive mechanism of the seal 114 (in this example, the solenoid 306) may be some distance from the diaphragm 200, for example being located somewhere other under the platform 300. This may reduce the burden for maintenance and replacement of such components, which may be provided in a relatively more accessible location. In some examples, the seal 114 and the associated actuation mechanism may be arranged outside a relatively hostile environment which may be created under the platform 300.

Figure 4:
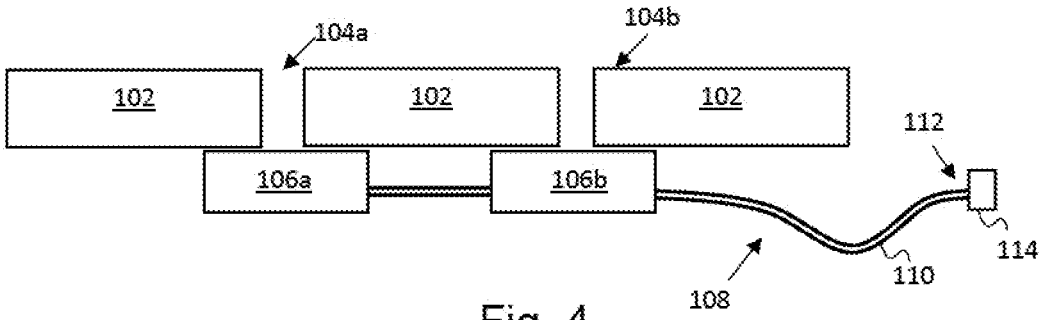
FIG. 4 is a schematic diagram of another example media conveyor.

FIG. 4 shows a schematic example in which a plurality of valves 106*a*, 106*b*, in this example a first 106*a* and a second 106*a* valve, associated respectively with a first 104*a* and second 104*b* suction hole, are in fluid communication such that the valve actuator 108 can actuate both (or more generally, any number) of the valves as a group using a single seal 114. Each of these valves may comprise a valve 106 which is responsive to a pressure differential, for example comprising a valve 301 as shown in FIG. 3A or 3B. If the valves were as shown in FIGS. 3A and 3B, the chambers 310 under the diaphragms 200 of a plurality of valves 301 may be connected, for example by an air tube such as the air tube 110 described above, or in some other way. The regions 312 on the second side of the diaphragms 200 may be in fluid communication (for example, comprising part of the same negative pressure chamber, for example being connected to the same vacuum source(s), or could be separate from one another.

In this way, 'sectorisation' of the suction provided under a platform 102 may be provided. For example, the valves may be controlled as columns, which may run the whole or part of the length of the platform 102. As media can vary in width, this allows the width over which suction is provided to be tailored to a particular media being conveyed. In other examples, the platform may be divided into zones, with the media being passed from one zone to the next. Suction may be provided (i.e. valves controlled such that the suction holes are opened) to coincide with the presence of media in a zone.

The complexity of control of individual valves or a large number of groups of valves may be balanced with the versatility of the apparatus for a particular intended use. For example, smaller groups of valves 106 controlled by a single actuator 108 (or providing more valves which may be controlled individually) allow a region of the platform 102 which provides suction to closely match the size of the particular media being processed. This in turn allows for energy efficiency and allows, for example, lower power vacuum sources to be used to provide a threshold suction. However, the control system of such a versatile arrangement may be more complex that an arrangement in which fewer, larger groups of valves 106 are controlled by a single valve actuator 108.

The maximum number or configuration of valves 106 controlled in a group depends on the airflow losses in the air tube 110, and the ratio between the tube diameter and the bleed hole size. In some examples, around two to ten valves 106 may be controlled in a group, although a group could comprise more than ten valves 106.

Figure 5:
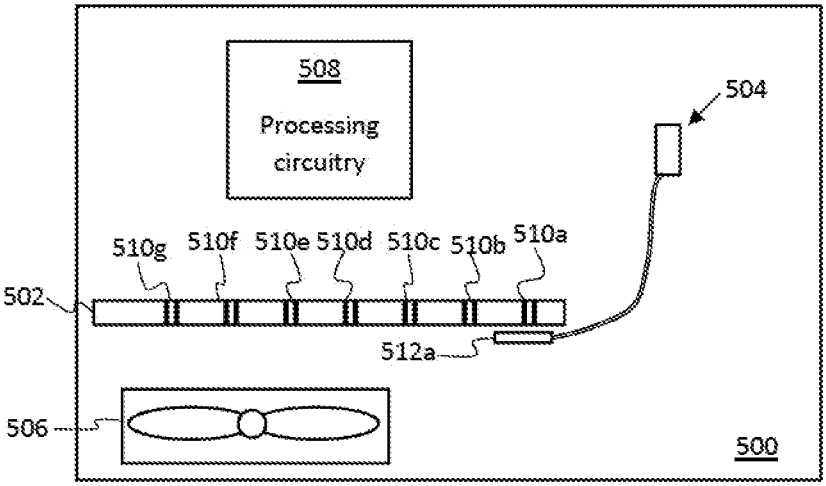
FIGS. 5 and 6 are schematic diagrams of example media handling apparatus.

FIG. 5 is an example of a media handling apparatus 500 comprising a media support platform 502, a valve actuator 504, a negative pressure source 506 and processing circuitry 508.

The media support platform 502 comprises a plurality of suction holes 510*a-g* (generally referred to with reference numeral 510). In association with a first suction hole 510*a* of said suction holes 510, there is a first valve 512*a* to selectively close the associated suction hole 510*a*. In this example, the first valve 512*a* comprises a diaphragm having a position which is responsive to a pressure differential, which may for example comprise a diaphragm 200 as described in relation to FIGS. 2 and 3 above.

The valve actuator 504 in this example comprises an air tube comprising a selectively sealable inlet (for example as shown in relation to FIGS. 1, 3 and 4) and may selectively actuate the first valve 512*a*.

The negative pressure source 506 is arranged, in use of the apparatus 500, to cause suction of air through a suction hole 510 when that suction hole 510 is open. The negative pressure source 506 in this example comprises an axial fan, but other vacuum sources such as vacuum pumps, centrifugal blowers, other types of fans or the like may be used.

The processing circuitry 508 is arranged to determine, based on an attribute of a media being handled by the media handling apparatus 500 (for example, conveyed, printed or the like), if the first suction hole 510*a* should be open or closed and to control the valve actuator 504 according to the determination. For example, the attribute may comprise at least one dimension, such as a length or width, another physical characteristic such as weight, thickness, porosity (permeability) or stiffness, or the position of the media within the apparatus 500. In some examples, such attributes may be provided for example by a user of the media handling apparatus 500. Combinations of attributes may be considered. In some examples, the media handling apparatus 500 may comprise detectors to detect at least one attribute of the media. For example, edge detectors may be provided to detect the edge positioning, media detectors may detect the presence of media, thickness detectors may detect a substrate thickness and the like.

In this example, the drive mechanism of the valve actuator 504 is provided remotely from the platform 502. This may be, for example, in a region of the apparatus 500 which is away from vacuum and/or high temperature conditions, free from vapours and condensation and/or more readily accessible for maintenance purposes.

Figure 6:
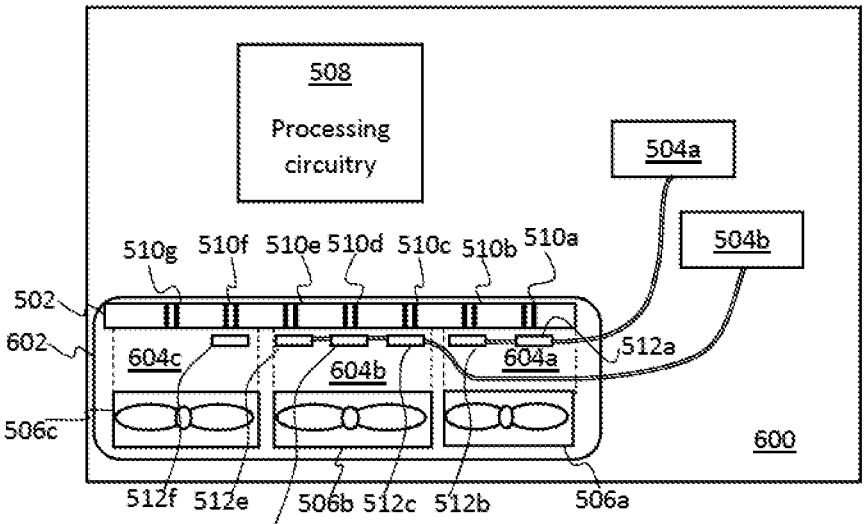

FIG. 6 is another example of a media handling apparatus, in this example a print apparatus 600 comprising a media support platform 502 and processing circuitry 508. A media conveying belt 602 is provided to carry media across the media support platform 502. This may for example be a fabric, plastic mesh or otherwise permeable endless belt (in some examples, driven with at least one roller (not shown). However, in other examples, the platform 502 may comprise, for example, a loop of pallets.

In this example, the print apparatus comprises a first 504*a* and second 504*b* valve actuator as well as a first 506*a*, second 506*b* and third 506*c* negative pressure source. Each negative pressure source 506*a-c* is associated with a respective negative pressure chamber 604*a-c*. The negative pressure chambers 604*a-c* are at least substantially separate from one another, and each is associated with a different subset of suction holes 510. In this way, each negative pressure source 506*a-c* may draw air through a different subset of the suction holes 510 (wherein a subset comprises at least one suction hole 510).

In this example, the negative pressure sources 506*a-c* are shown to be within the belt 602, although this may not be the case, and at least one duct may be provided between each source 506 and a negative pressure chamber 604.

The presence of such a belt 602 assists in smoothly conveying the media, but may interfere with a seal being formed simply by the presence of media on the belt, as air can leak through the belt 602 itself into a pilot hole or the like, even when the media overlies such a hole.

Providing a plurality of negative pressure sources 506*a-c* means that a source 506*a-c* may be selected according to the region with which it is associated. For example, it may be that different regions are associated with different stages of media handling, for example operating at different temperatures and/or preforming different functions, which may in turn mean that different suction levels are intended. In such examples, providing a plurality of sources 506*a-c* may allow a source 506 to be selected which is compatible with its intended operation. It may also allow smaller or less powerful negative pressure sources 506 to be employed, which may be less expensive and more readily available than a single, more powerful negative pressure source 506. Providing a plurality of negative pressure chambers 604*a-c* may also facilitate the provision of different negative pressure conditions in different regions. In some examples, the negative pressure chambers 604*a-c* may include the regions 312 on the second side of the diaphragms 200 described in relation to FIGS. 3A and 3B above.

In the example of FIG. 6, a first 512*a* and second 512*b* valve are selectively to close a first 510*a* and second 510*b* suction hole under control of the first valve actuator 504*a*. A third 512*c*, fourth 512*d* and fifth 512*e* valve are selectively to close a third 510*c*, fourth 510*d* and fifth 510*e* suction hole under control of the second valve actuator 504*b*. A sixth suction hole 510*f* is closed by a valve 512*f* directly actuated by presence of media. For example, the media may pass over the top of a pilot hole which acts in the same way as sealing the end of the air tube 110. A seventh suction hole 510*g* is not associated with a valve and is always open. This may allow for pressure release and/or may for example be a suction hole 510 in the centre of the platform which is more likely to carry media, if when the media is narrow. More generally, a print apparatus or a media conveyor or a region thereof may comprise a combination of valves having different (or in some examples, no) actuation mechanisms.

As noted above, in this example, each of the negative pressure sources 506*a-c* is associated with a different negative pressure chamber 604*a-c* which in turn is connected to cause suction of air through a subset of the suction holes 510. At least one, and in some examples, each, negative pressure chamber 604 may comprise a sensor to monitor the pressure level. Such a sensor may provide feedback to a negative pressure source 506.

In this example, a first negative pressure chamber 604*a* is associated with a region of the media support platform 502 which is to support a print media during a first print operation (for example, drying and curing), the second negative pressure chamber 604*b* is associated with a region of the media support platform 502 which is to support a print media during a second, different print operation (for example, printing inks, toners and the like onto media by means of a printhead mounted on a moveable carriage, or an array of static print heads or the like, which may eject drops of ink through orifices or nozzles and towards a print media so as to print onto the media), and the third negative pressure chamber 604*c* is associated with a region of the media support platform 502 which is to support a print media during a second, different print operation (for example, loading the print media into the print apparatus 600).

In some examples, different regions of the media support platform 502 comprise different compositions of suction holes. For example, it may be that, in a printing region, it is to be assured that more suction is applied than in a loading region as in such a section print apparatus components such as print heads may pass close to the media and therefore holding the print media securely may reduce smearing or misapplication of the print agent. This could be achieved by provided more actuatable valves 512 in the printing region than in the loading region, such that suction is not wasted due to un-sealed suction holes 510. In a drying or curing region, hot air may be provided and in order to prevent wasting energy, it may be of relatively higher concern to seal off otherwise uncovered suction holes 510 in such a region than in other regions. Therefore, it may the case that valves are controllable to a higher resolution in such a region (i.e. smaller groups of valves 512 are controlled by a single actuator). In some examples, the configuration may be a configuration of groups of valves controlled by a single valve actuator 504. For example, in one region, the resolution of the groups may be different than in another, or the groups may comprises different shapes or forms. In some examples, varying the composition of suction holes may comprises varying the provision of holes which are always open and/or holes which are associated with valves which are controlled in some other way than by sealing an air tube.

Figure 7:
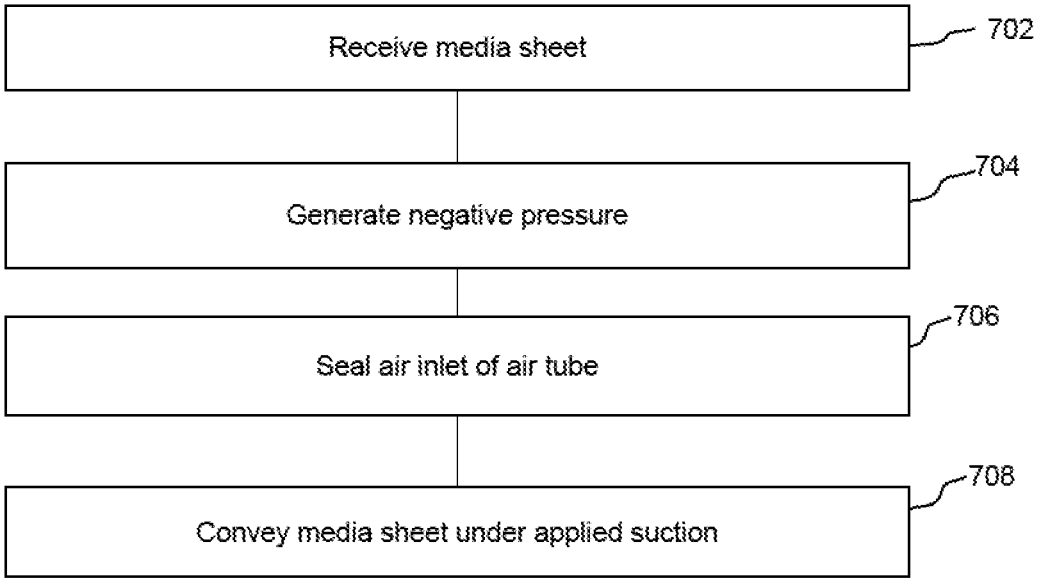
FIG. 7 is a flowchart of an example method of conveying a media sheet.

FIG. 7 is a flow chart of an example of a method comprising, in block 702, receiving, on a media support platform of a media handling apparatus, a media sheet. Block 704 comprises generating a negative pressure. In block 706, an actuation signal is generated to selectively seal an inlet to an air tube and thereby cause a pressure operated valve to communicate the negative pressure to the media sheet as an applied suction. In some examples, sealing the air tube causes a plurality of pressure operated valves to communicate the negative pressure to the media sheet as a suction via a plurality of respective suction holes. Block 708 comprises conveying the media sheet on the media support platform under the applied suction. The method may be a method of operating the media handling apparatus 500 or the print apparatus 600

Examples in the present disclosure can be provided as methods, systems or machine readable instructions, such as any combination of software, hardware, firmware or the like, which may for example be executed by the processing circuitry 508. Such machine readable instructions may be included on a computer readable storage medium (including but is not limited to disc storage, CD-ROM, optical storage, etc.) having computer readable program codes therein or thereon. The machine readable instructions may, for example, be executed by a general purpose computer, a special purpose computer, an embedded processor or processors of other programmable data processing devices to realize the functions of the processing circuitry 508 described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Further, the teachings herein may be implemented in the form of a computer software product, the computer software product being stored in a storage medium and comprising a plurality of instructions for making a computer device implement the methods recited in the examples of the present disclosure.

The present disclosure is described with reference to a flow chart. Although the flow diagram described above shows a specific order of execution, the order of execution may differ from that which is depicted. It shall be understood that each block in the flow chart, as well as combinations thereof can be realized by machine readable instructions. In some examples, at least some blocks may be carried out by the processing circuitry 508.

Features described in relation to one example may be combined with features described in relation to any other example.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A media conveyor comprising:

a media support platform comprising a suction hole;

a valve to selectively close the suction hole; and a valve actuator to actuate the valve and comprising an air tube, the air tube comprising an air inlet, and a seal to selectively seal the air inlet.

2. The media conveyor of claim 1 comprising a solenoid to reposition the seal relative to the air inlet.

3. The media conveyor of claim 1 wherein the valve comprises a diaphragm having a convolution comprising a pair of concentric annular walls.

4. The media conveyor of claim 1 wherein the valve comprises a bleed hole, and wherein a size of the bleed hole is less than a size of at least one of the air tube and the air inlet.

5. The media conveyor of claim 4, wherein the air tube is connected to a chamber on a first side of valve, wherein the chamber is connected to a negative pressure source via the bleed hole.

6. The media conveyor of claim 1 wherein:

the media support platform comprises a plurality of suction holes and a plurality of valves, each valve to selectively close an associated suction hole; and the valve actuator is to selectively actuate the plurality of valves as a group.

7. A media handling apparatus comprising:

a media support platform comprising a plurality of suction holes and, in association with a first suction hole of the suction holes, a first valve to selectively close the first suction hole, the first valve comprising a diaphragm having a position which is responsive to a pressure differential;

a valve actuator comprising an air tube having a selectively sealable air inlet, the valve actuator being to selectively actuate the first valve;

a negative pressure source to cause suction of air through the first suction hole when the first suction hole is open; and processing circuitry to determine, based on an attribute of a media being handled by the media handling apparatus, if the first suction hole should be open or closed and to control the valve actuator according to the determination.

8. The media handling apparatus of claim 7 comprising a media conveying belt, wherein the media conveying belt is to carry media across the media support platform.

9. The media handling apparatus of claim 7 comprising, in association with a second suction hole of the suction holes, a second valve to selectively close the second suction hole, the second valve comprising a diaphragm having a position which is responsive to a pressure differential, wherein the valve actuator is to selectively actuate the first and second valves.

10. The media handling apparatus of claim 7 in which the plurality of suction holes comprises a third suction hole which is always open or which is closable by a valve directly actuated by presence of media.

11. The media handling apparatus of claim 7 comprising a plurality of negative pressure chambers, wherein each negative pressure chamber is connected to a subset of the plurality of suction holes.

12. The media handling apparatus of claim 11 comprising a print apparatus and in which a first negative pressure chamber of the negative pressure chambers is associated with a region of the media support platform which is to support a print media during a first print operation and a second negative pressure chamber of the negative pressure chambers is associated with a region of the media support platform which is to support a print media during a second, different print operation.

13. The media handling apparatus of claim 7 wherein a first region of the media support platform comprises a first composition of suction holes and a second region of the media support platform comprises a second, different, composition of suction holes.

14. A method comprising:

receiving, on a media support platform of a media handling apparatus, a media sheet;

generating a negative pressure;

generating an actuation signal to selectively seal an inlet of an air tube and thereby cause a pressure operated valve to communicate the negative pressure to the media sheet as an applied suction; and conveying the media sheet on the media support platform under the applied suction.

15. The method of claim 14, wherein sealing the inlet of the air tube causes a plurality of pressure operated valves to communicate the negative pressure to the media sheet as a suction via a plurality of respective suction holes.

* * * * *